US008157665B2

(12) United States Patent
Gibbs

(10) Patent No.: US 8,157,665 B2
(45) Date of Patent: Apr. 17, 2012

(54) GOLF SWING TRAINING DEVICE FOR CORRECTING ARM POSITION AND HIP ROTATION SEQUENCE

(76) Inventor: Daniel D. Gibbs, Gig Harbor, WA (US)

( * ) Notice: Subject to any disclaimer, the term of this patent is extended or adjusted under 35 U.S.C. 154(b) by 84 days.

(21) Appl. No.: 12/843,777

(22) Filed: Jul. 26, 2010

(65) Prior Publication Data

US 2012/0021846 A1 Jan. 26, 2012

(51) Int. Cl.
*A63B 69/36* (2006.01)

(52) U.S. Cl. ..... 473/215; 473/216

(58) Field of Classification Search ..... 473/207, 473/212–217, 219, 266, 269, 277, 461, 464
See application file for complete search history.

(56) References Cited

U.S. PATENT DOCUMENTS

| | | | | | |
|---|---|---|---|---|---|
| 1,591,523 | A * | 7/1926 | Fuller | 473/215 |
| 1,591,524 | A * | 7/1926 | Fuller | 473/215 |
| 1,669,457 | A * | 5/1928 | Dailey | 473/215 |
| 2,773,691 | A * | 12/1956 | Redfield | 473/212 |
| 4,519,608 | A * | 5/1985 | Gilly | 473/461 |
| 5,643,097 | A | 7/1997 | Bechler et al. | |
| D404,103 | S * | 1/1999 | Winters | D21/791 |
| 6,458,036 | B1 | 10/2002 | Gutierrez | |
| 6,503,148 | B2 | 1/2003 | Lane | |
| 6,514,150 | B1 | 2/2003 | Corder | |
| 6,582,318 | B1 | 6/2003 | Halfacre | |
| 7,066,825 | B1 | 6/2006 | Moussa | |
| 7,156,748 | B2 | 1/2007 | Burke | |
| 2007/0191129 | A1 | 8/2007 | Kearns et al. | |
| 2008/0176665 | A1 | 7/2008 | Snyders | |
| 2008/0182678 | A1 | 7/2008 | Brooks et al. | |
| 2009/0239675 | A1 | 9/2009 | Wallace | |

* cited by examiner

*Primary Examiner* — Nini Legesse
(74) *Attorney, Agent, or Firm* — George A. Leone; Citadel Patent Law

(57) ABSTRACT

A golf training device includes an elongated pointer shaft having a proximal end and a distal end. A connector is adapted to fasten to a golfer's waist, where the proximal end of the elongated pointer shaft is attached to the connector and the distal end is free to encroach into an inside downward path of the golfer. An elbow swing alignment element upwardly protrudes from the elongated pointer shaft between the proximal end and the distal end. The elongated pointer shaft and elbow swing alignment element are located so that the elbow swing alignment element contacts the golfer's inside elbow when crooked, thus providing a corrective indication.

20 Claims, 7 Drawing Sheets

GOLF SWING TRAINING DEVICE FOR CORRECTING ARM POSITION AND HIP ROTATION SEQUENCE

FIELD OF THE INVENTION

The present invention relates to a golf teaching aid for a golf player to practice correct golf stance and swings when using different golf clubs.

BACKGROUND OF THE INVENTION

From observations of professional golfers it has been noted that at the impact position of their golf swing their hips are open to the target line and their shoulders are square to the target line. At the same time, a proper golf swing requires that the leading arm (i.e. the left arm for a right handed golfer or the right arm for a left-handed golfer) be kept straight from the shoulder to the wrist.

Unfortunately, recreational golfers usually have several flaws in their swings. Typically recreational golfers keep their hips square and their shoulders open to the target line. Also, they typically bend their leading arm at the elbow during their swing in a condition commonly known as "chicken wing."

Some golf training aids have tried to address the hip rotation problems. Others have attempted addressing the elbow angle problem using belts, wraps and bands that are cumbersome at best. An elegant training aid for teaching both proper hip rotation and leading arm positioning is lacking. Thus, there is a long felt, unsolved need for a teaching aid that will train a golfer to use the proper sequence of hip and shoulder rotation and avoid "chicken wing" type elbow bending by allowing them to actually feel the proper sequence using visual, tactile and auditory feedback.

SUMMARY OF THE DISCLOSURE

A golf training device includes an elongated pointer shaft having a proximal end and a distal end. A connector is adapted to fasten to a golfer's waist, where the proximal end of the elongated pointer shaft is attached to the connector and the distal end is free to encroach into an inside downward path of the golfer. An elbow swing alignment element upwardly protrudes from the elongated pointer shaft between the proximal end and the distal end. The elongated pointer shaft and elbow swing alignment element are located so that the elbow swing alignment element contacts the golfer's inside elbow when crooked, thus providing a corrective indication.

BRIEF DESCRIPTION OF THE ACCOMPANYING DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION OF PREFERRED EMBODIMENTS OF THE INVENTION

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one example" or "an example embodiment," "one embodiment," "an embodiment" or various combinations of these terms means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
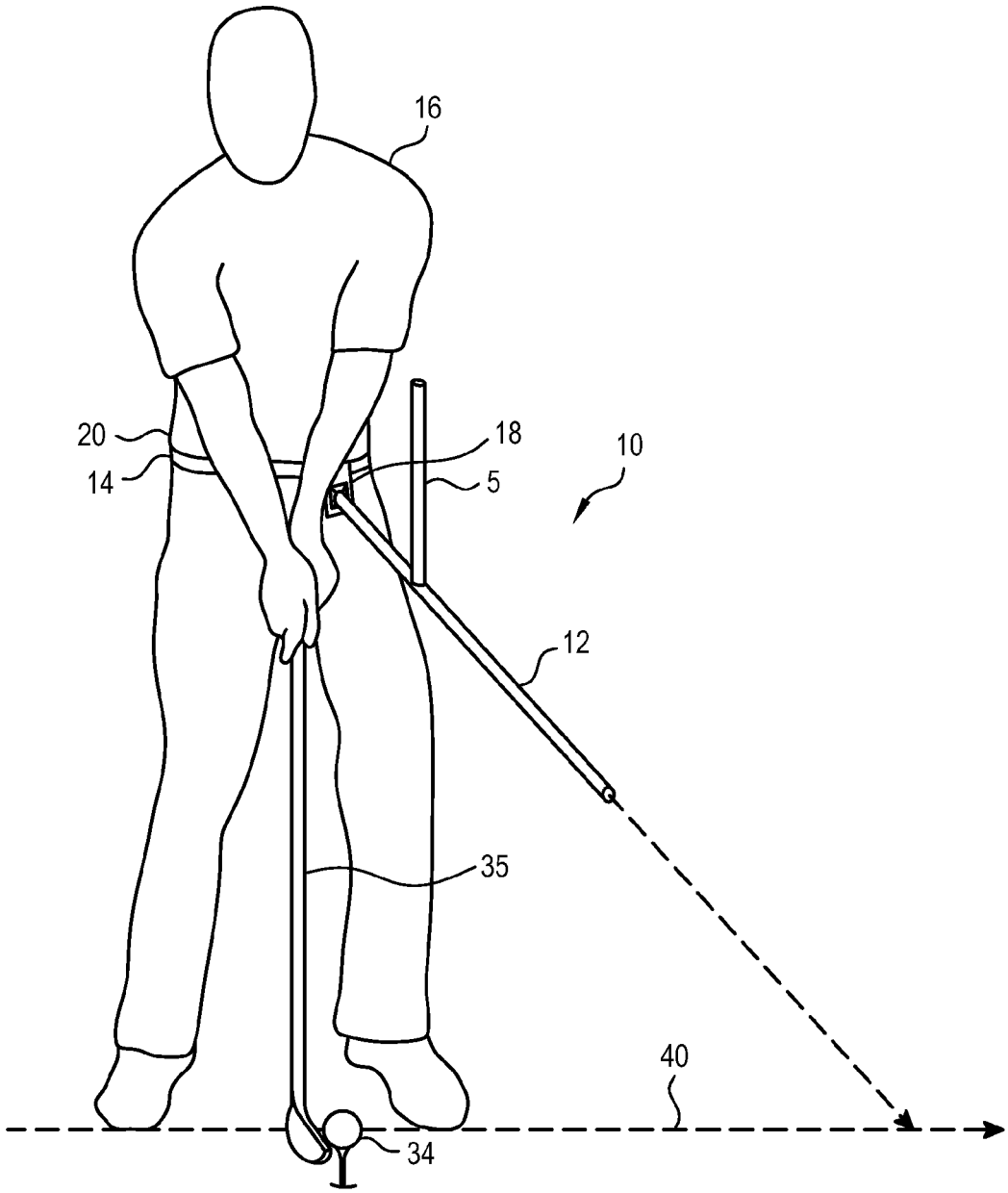
FIG. 1 is a perspective view of a golfer addressing a ball prior to his golf swing using golf swing training apparatus constructed in accordance with the teachings of the present disclosure.
Figure 4:
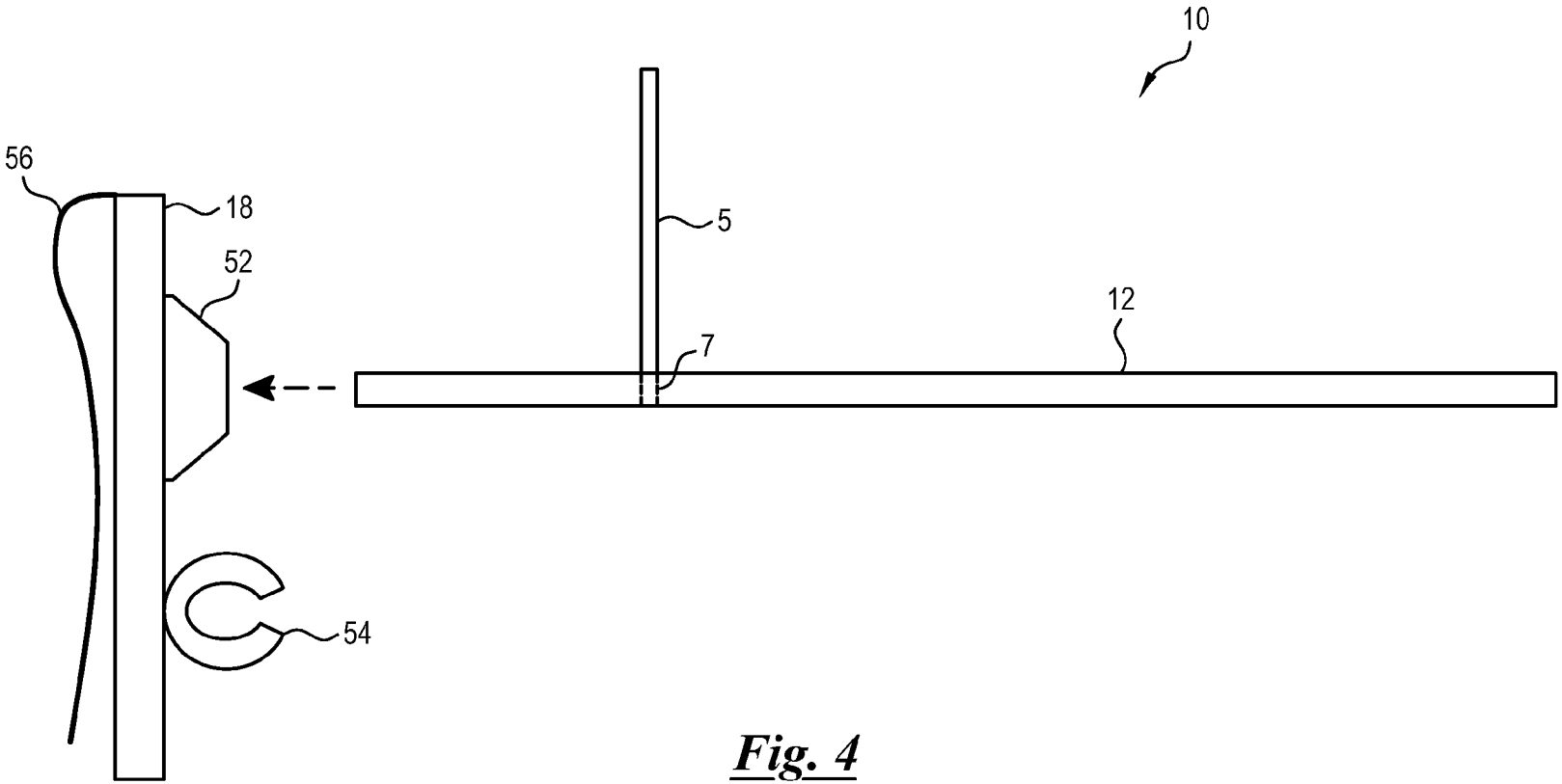
FIG. 4 is a side view of a golf swing training apparatus constructed in accordance with the teachings of the present disclosure.

Referring to FIG. 1, a perspective view of a golfer addressing a ball prior to his golf swing using golf swing training apparatus constructed in accordance with the teachings of the present disclosure is shown. Golf training apparatus 10 includes a pointer shaft 12. Mounted on the pointer shaft is an upwardly protruding elbow swing alignment element 5. The pointer shaft 12 is intended to be adapted for attachment to a waist 20 of a golfer 16. This can be done in a number of ways. The pointer shaft 12 is adapted to be attached to a connector as, for example, a belt clip 18 (as best shown in FIG. 4), which can clip onto a belt 14 worn by golfer 16. The pointer shaft 12 extends outwardly from belt clip 18 when fastened to the golfer's waist and points along a target line 40. This is considered a starting position for pointer shaft 12 for, as will hereinafter be further described, pointer shaft 12 is capable of omni-directional movement.

Still referring to FIG. 1, it can be seen how golfer 16 can check to ensure he is correctly positioned in preparation for hitting a golf ball 34 toward a target. He does this by making sure that pointer shaft 12 is pointing to the target line 40 when addressing the golf ball 34 with his golf club shaft 35 perpendicular to the target line 40. The proper position can be adjusted by the golfer positioning the belt clip over his insider thigh (i.e. the inside leg being the leg closest to the target or hole).

Figure 2:
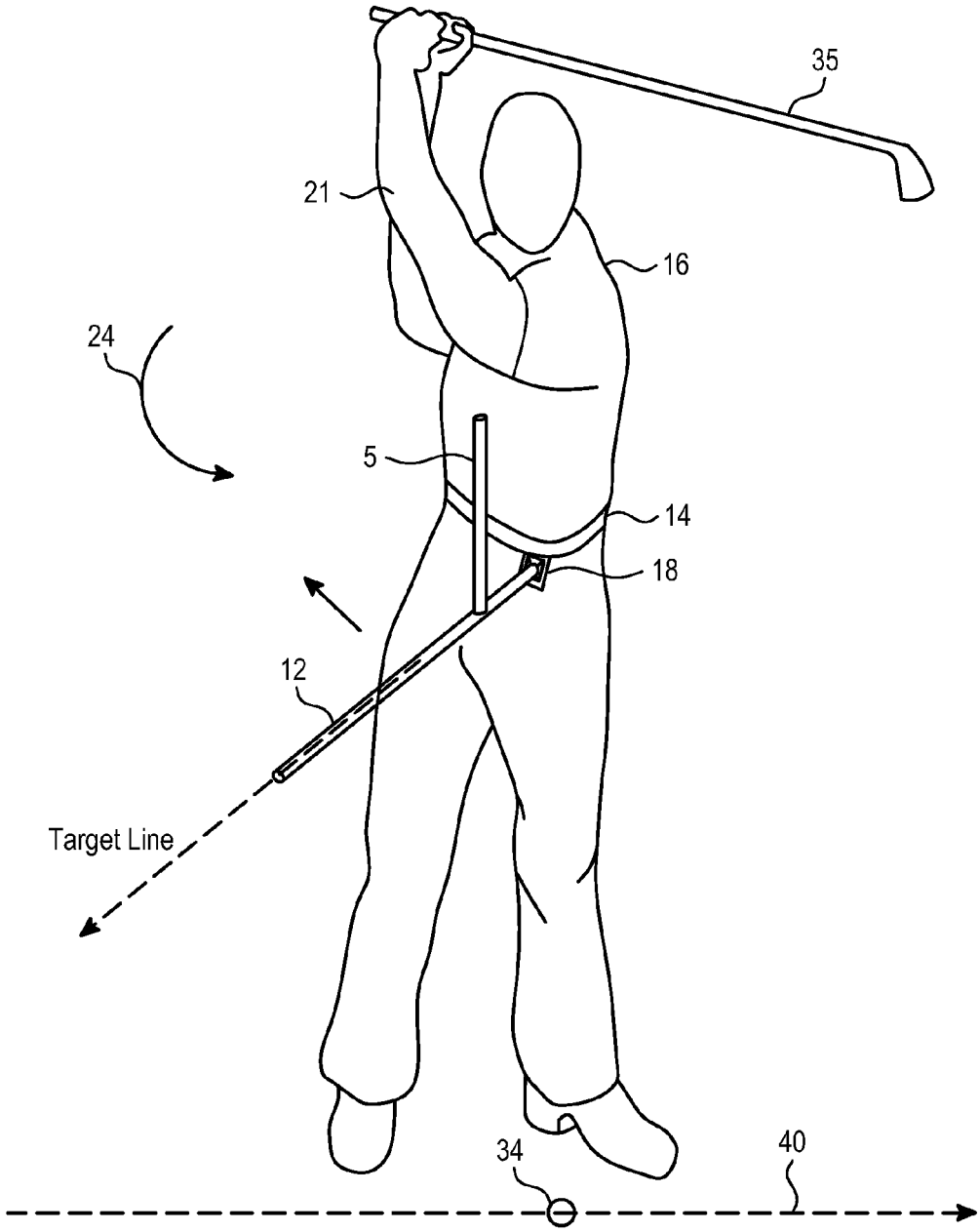
FIG. 2 is a perspective view of a golfer on the backswing about to commence a downward portion of his golf swing using golf swing training apparatus constructed in accordance with the teachings of the present disclosure.

Referring now to FIG. 2, a perspective view of the golfer on the backswing about to commence a downward portion of his golf swing using golf swing training apparatus constructed in accordance with the teachings of the present disclosure is shown. Once at the top of his swing, a golfer is taught to adopt a downward motion of pushing the training apparatus with weight shift and hips and to keep clearing the hips so that left forearm and club shaft miss the apparatus. With hip apparatus golfers can check for correct hip position on the downswing and follow through. The golfer 16 can check to confirm correct positioning of his golf club and arms during the course of his downward swing if his forearm 21 or club shaft 35 does not strike pointer shaft 12. This will be the left forearm for a right handed golfer and the right forearm for a left handed golfer. Pointer shaft 12 extends into inside downward swing path 24 of golfer 16. If forearm 21 or club shaft 35 of golfer 16 does not strike pointer shaft 12, golfer 16 is correctly following an inside downward swing path.

On the back swing, pointer shaft 12 can be used to check that the correct hip tilt has been maintained in preparation for a good downswing. Pointer shaft 12 should still be pointing down toward the target line just outside the right foot (for right handed golfers) or the left foot (for left handed golfers). If golfer 16 has an improper weight transfer, pointer shaft 12 will point away from the target line. When worn, as described, pointer shaft 12 is adapted to encroach into an inside downward swing path, generally indicated by arrow 24, of golfer 16.

Figure 3:
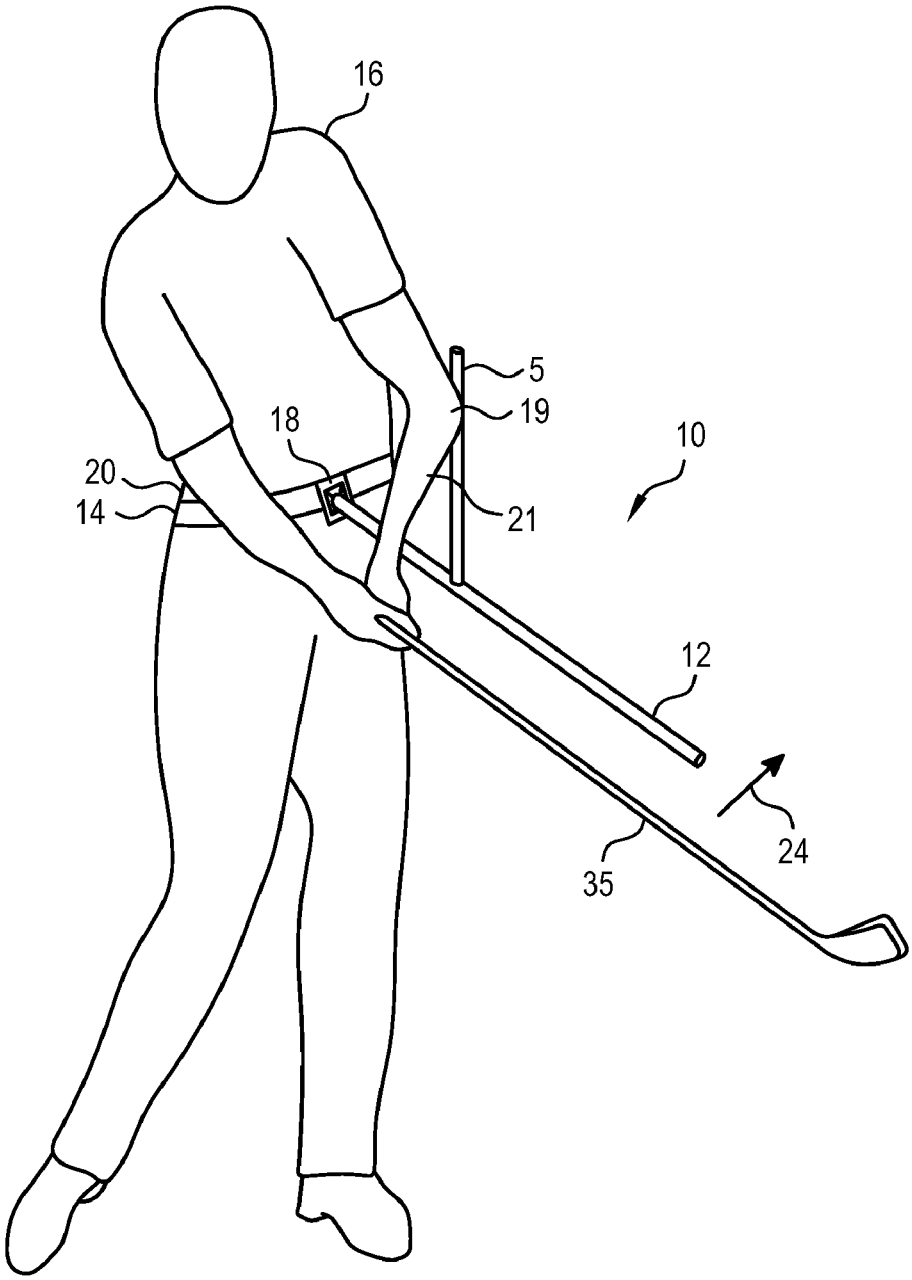
FIG. 3 is a perspective view of a golfer in the follow-through portion of his golf swing using golf swing training apparatus constructed in accordance with the teachings of the present disclosure.

Referring now to FIG. 3, a perspective view of the golfer in the follow-through portion of his golf swing using golf swing training apparatus constructed in accordance with the teachings of the present disclosure is shown. There shown is the golfer 16 with his elbow 19 in the improper "chicken wing" position. In this position, the golfer's elbow 19 will contact the elbow swing alignment element 5, thereby reminding the golfer to keep his arm 21 in a straight position while swinging. When the proper arm position is maintained the golfer's elbow will not make contact with the swing alignment element 5.

Referring now to FIG. 4 a side view of a golf swing training apparatus constructed in accordance with the teachings of the present disclosure is shown. The belt clip 18 includes a mounting base 52, a spring clip 56 and a front clip 54. The mounting base is located on the front of the belt clip 18 and the spring clip 56 may advantageously be located and connected to protrude proximate the back of the belt clip 18.

Figure 5:
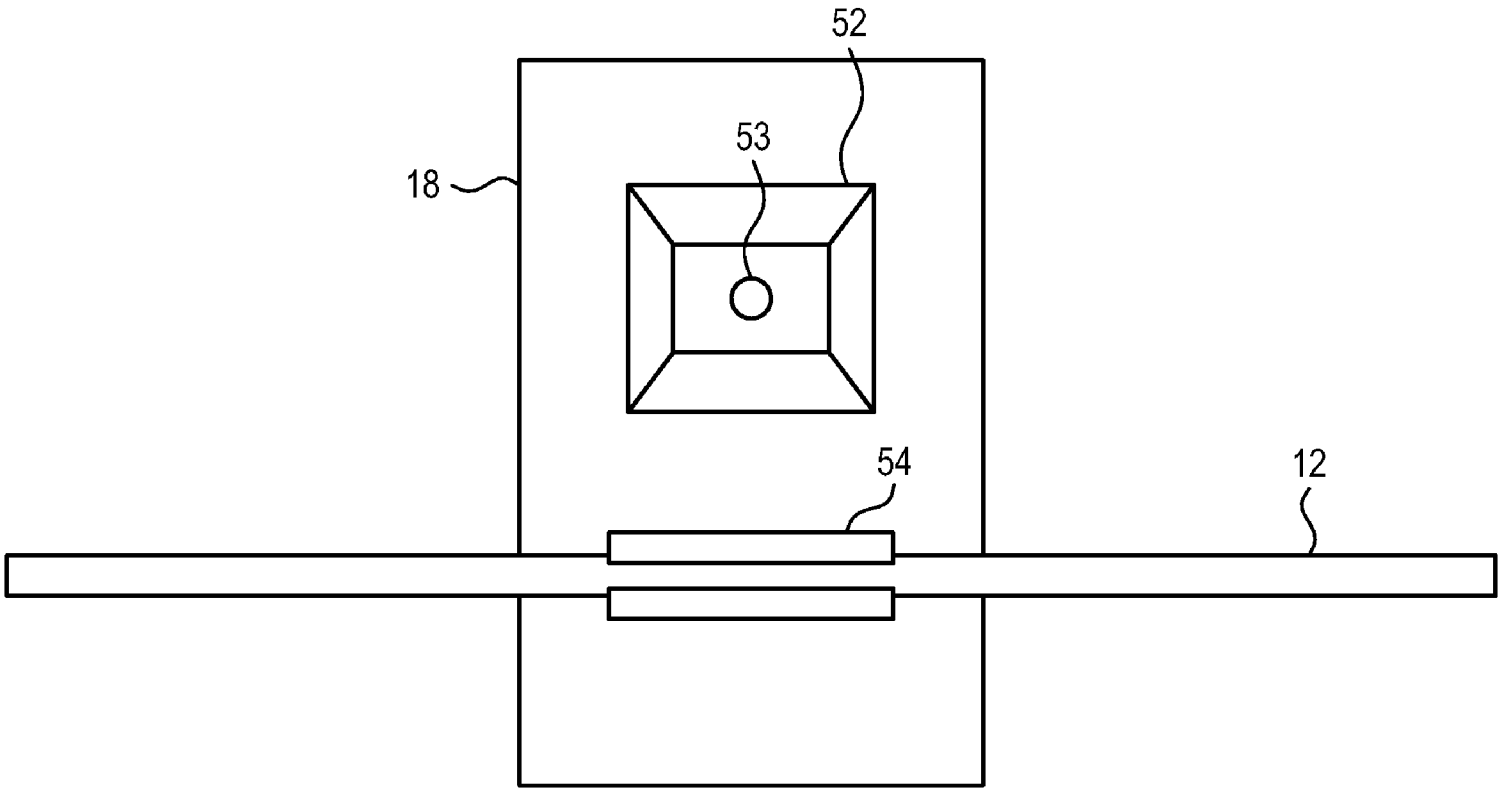
FIG. 5 is a front view of a belt clip used with a golf swing training apparatus constructed in accordance with the teachings of the present disclosure.

The pointer shaft 12 may be attached to the belt clip 18 by fastening into a mounting hole 53 (See FIG. 5). Any suitable fastening means may be used, as, for example, a tight fit or a male-female screw arrangement between the base and one end of the pointer shaft. In a preferred embodiment the pointer shaft is removable when desired. In one example, the elbow swing alignment element 5 may be attached to the pointer shaft 12 with a mounting clip 7 enabling it to be removed for certain exercises and positioned according to the user's size and arm length. In some useful embodiments the length of the pointer shaft 12 may range from about 30" to 33", although it can certainly be made shorter or longer to accommodate different sized golfers. The elbow swing alignment element 5 can varying in length, although it must be long enough to make contact with a bent elbow during a swing, but short enough not to unduly impede a golfer's swing. The length may also vary depending on the size of the golfer, although it will be shorter than the pointer shaft 12.

The pointer shaft 12 and the elbow swing alignment element 5 may be made from any suitable material, such as that used for golf shafts or the like. Materials may be selected from plastic, metal, nylon, graphite, wood, combinations thereof and the like.

Referring now to FIG. 5, a front view of a belt clip used with a golf swing training apparatus constructed in accordance with the teachings of the present disclosure is shown. The belt clip 18 includes the mounting base 52 with a mounting hole 53 suitably sized to accept one end of the pointer shaft 12 for attachment thereto. The spring clip 54 may be made of any suitable plastic, metal or spring-like material and be sized to securely hold the pointer shaft 12 when clipped into the spring clip 54 in a lengthwise position parallel to a target line. In this view the pointer shaft 12 is shown clipped into the spring clip 54.

Figure 6:
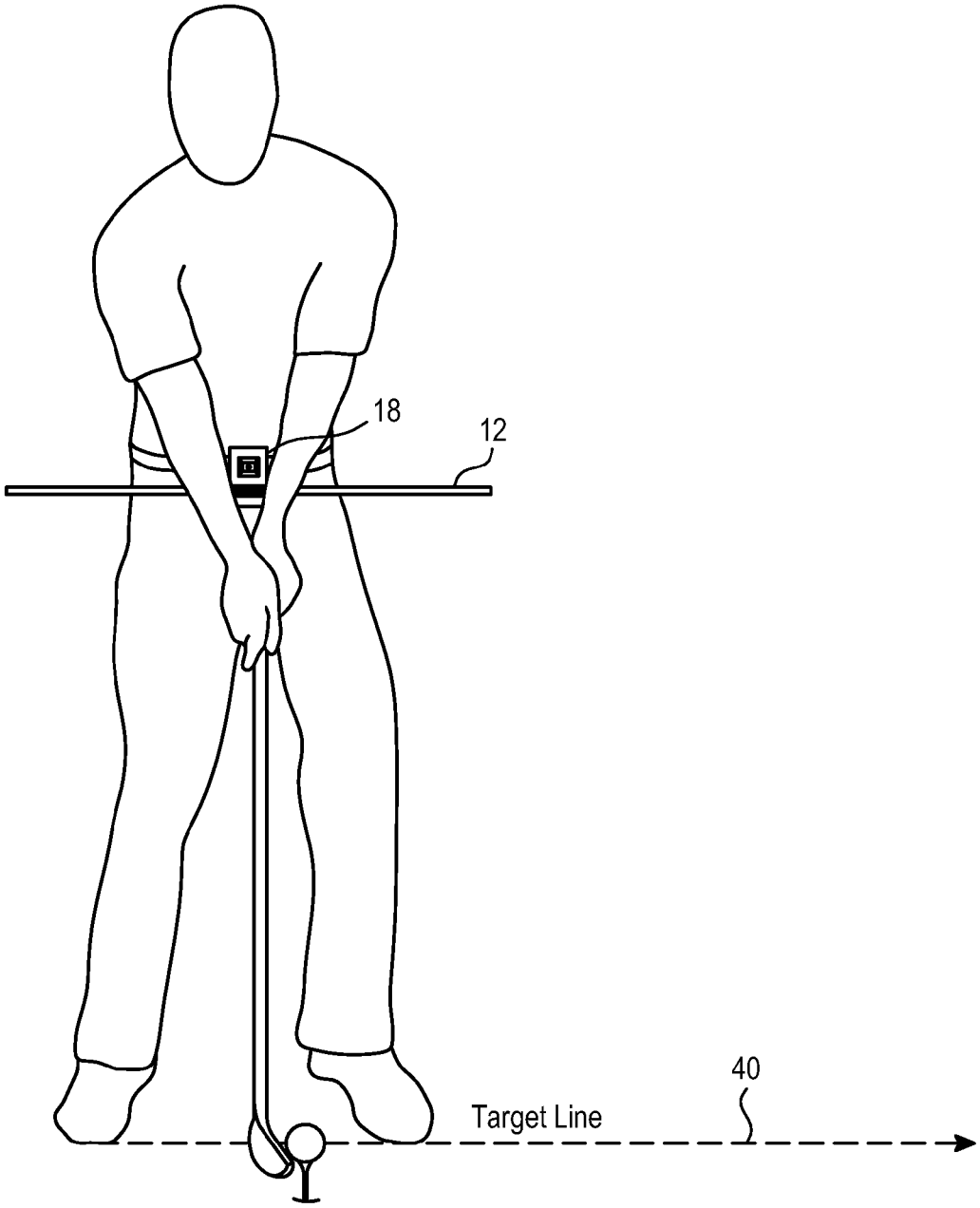
FIG. 6 is a perspective view of a golfer addressing a ball prior to his golf swing using golf swing training apparatus in a configuration for aiding proper body alignment.

Referring now to FIG. 6, a perspective view of a golfer addressing a ball prior to his golf swing using golf swing training apparatus in a configuration for aiding proper body alignment is shown. Here the elbow swing alignment element 5 may be removed and the belt clip 18 is fastened to the middle of the golfer's waist. The pointer shaft 12 is clipped into the belt clip 18 and positioned parallel to the target line 40. Maintaining the relationship of the pointer shaft 12 to the target line 40 trains the golfer in the proper body position for addressing the ball.

Figure 7:
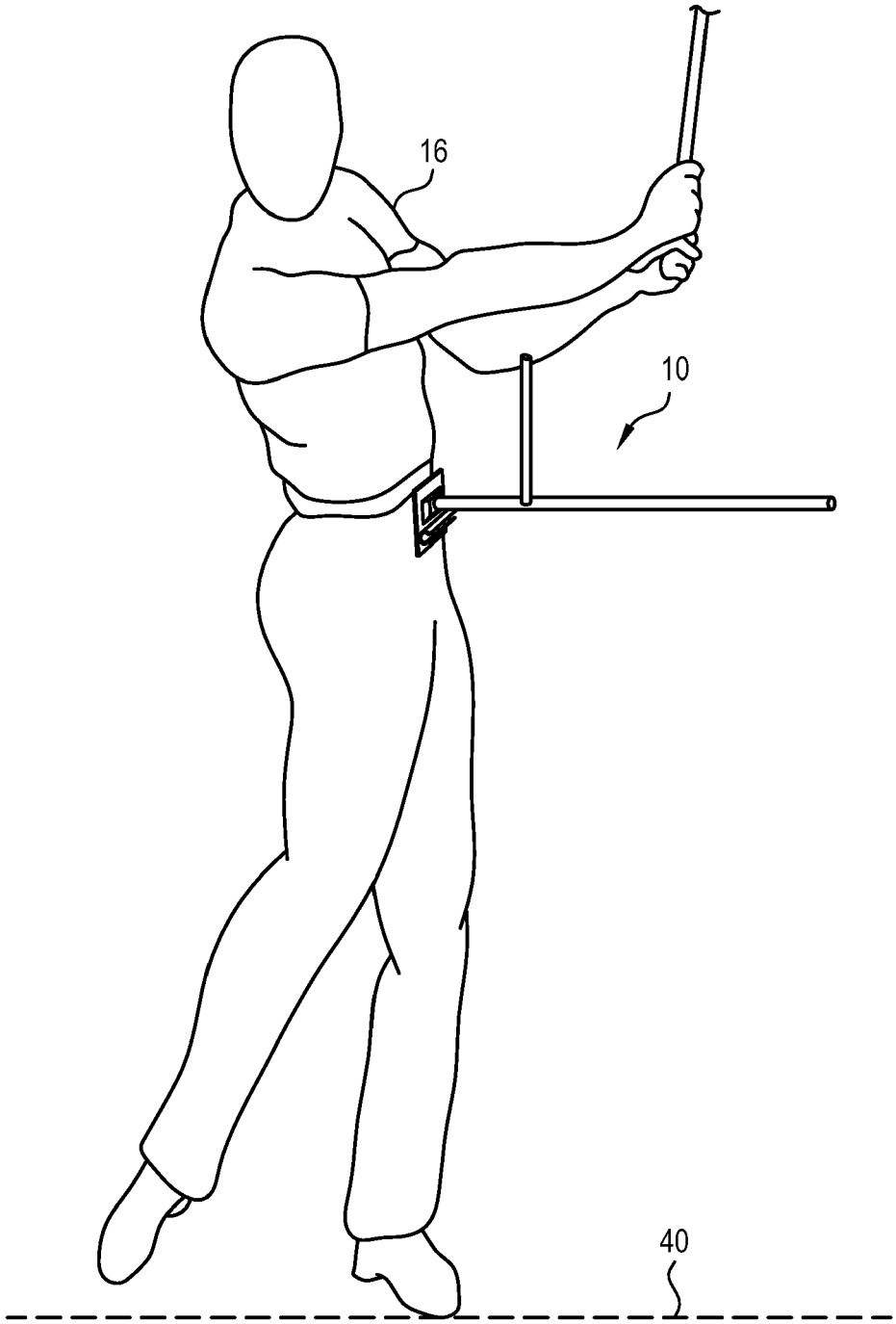
FIG. 7 is a perspective view of a golfer following through his golf swing using golf swing training apparatus in a configuration for aiding proper body alignment.

Referring now to FIG. 7, a perspective view of a golfer following through his golf swing using golf swing training apparatus in a configuration for aiding proper body alignment is shown. A golfer is taught that, upon completion of his follow through, he should be facing the target. Upon completion of his swing golfer 16 can check to see if he used a proper follow through by noting whether pointer shaft 12 is pointing toward the target hole parallel to underlying target line 40. This positioning is indicative of a complete weight transfer and balanced follow through.

The golf training aid, as described above, provides a valuable posture check during set up, during the back swing, during the downward portion of the golf swing and during completion of the follow through. This correct posture ensures that the body is balanced in a strong position to allow optimal room for the correct inside downward swing path of the golfer's forearms and club head.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A golf training device comprising:

an elongated pointer shaft having a proximal end and a distal end;

a connector adapted to fasten to a golfer's waist, where the proximal end of the elongated pointer shaft is attached to the connector and the distal end is free to encroach into an inside downward path of the golfer;

an elbow swing alignment element upwardly protruding from the elongated pointer shaft between the proximal end and the distal end; and where the elongated pointer shaft and elbow swing alignment element are located so that the elbow swing alignment element contacts the golfer's inside elbow when crooked, thus providing a corrective indication.

2. The golf training device of claim 1 wherein the connector comprises a belt clip including a mounting base adapted for connecting the proximal end of the elongated pointer shaft.

3. The golf training device of claim 2 wherein the belt clip further comprises a spring clip located on the back of the belt clip.

4. The golf training device of claim 2 wherein the belt clip further comprises a front clip located on the front of the spring clip, where the front clip is sized to accept and hold the elongated pointer shaft in a lengthwise position parallel to a target line.

5. The golf training device of claim 2 wherein the spring clip comprises material selected from the group consisting of plastic, metal, spring-like material and combinations thereof.

6. The golf training device of claim 1 wherein the elbow swing alignment element is adjustable along the length of the elongated pointer shaft.

7. The golf training device of claim 1 wherein the elongated pointer shaft has a length in the range of 30" to 33".

8. The golf training device of claim 1 wherein the elongated pointer shaft comprises material selected from the group consisting of plastic, metal, nylon, graphite, wood and combinations thereof.

9. The golf training device of claim 1 wherein the elongated pointer shaft being capable of omni-directional movement.

10. The golf training device of claim 1 wherein the elongated pointer shaft is positioned to confirm correct positioning of his golf club and arms during the course of his downward swing if his forearm does not strike pointer shaft.

11. A golf training device comprising:

an elongated pointer shaft having a proximal end and a distal end;

a belt clip adapted to fasten to a golfer's waist, where the proximal end of the elongated pointer shaft is attached to the belt clip and the distal end is free to encroach into an inside downward path of the golfer;

an elbow swing alignment element upwardly protruding from the elongated pointer shaft between the proximal end and the distal end, wherein the elbow swing alignment element is adjustable along the length of the elongated pointer shaft; and where the elongated pointer shaft and elbow swing alignment element are located so that the elbow swing alignment element contacts the golfer's inside elbow when crooked, thus providing a corrective indication.

12. The golf training device of claim 11 wherein the belt clip includes a mounting base adapted for connecting the proximal end of the elongated pointer shaft.

13. The golf training device of claim 12 wherein the elongated pointer shaft has a length in the range of 30" to 33".

14. The golf training device of claim 12 wherein the elongated pointer shaft comprises material selected from the group consisting of plastic, metal, nylon, graphite, wood and combinations thereof.

15. The golf training device of claim 13 wherein the spring clip comprises material selected from the group consisting of plastic, metal, spring-like material and combinations thereof.

16. The golf training device of claim 11 wherein the belt clip further comprises a spring clip located on the back of the belt clip.

17. The golf training device of claim 16 wherein the belt clip further comprises a front clip located on the front of the spring clip, where the front clip is sized to accept and hold the elongated pointer shaft in a lengthwise position parallel to a target line.

18. A golf training device comprising:

an elongated pointer shaft having a proximal end and a distal end, wherein the elongated pointer shaft has a length in the range of 30" to 33";

a belt clip adapted to fasten to a golfer's waist, where the proximal end of the elongated pointer shaft is attached to the belt clip and the distal end is free to encroach into an inside downward path of the golfer;

wherein the belt clip includes a mounting base adapted for connecting the proximal end of the elongated pointer shaft and wherein the belt clip further comprises a spring clip located on the back of the belt clip;

an elbow swing alignment element upwardly protruding from the elongated pointer shaft between the proximal end and the distal end, wherein the elbow swing alignment element is adjustable along the length of the elongated pointer shaft; and where the elongated pointer shaft and elbow swing alignment element are located so that the elbow swing alignment element contacts the golfer's inside elbow when crooked, thus providing a corrective indication.

19. The golf training device of claim 18 wherein the belt clip further comprises a front clip located on the front of the spring clip, where the front clip is sized to accept and hold the elongated pointer shaft in a lengthwise position parallel to a target line.

20. The golf training device of claim 18 wherein the elongated pointer shaft comprises material selected from the group consisting of plastic, metal, nylon, graphite, wood and combinations thereof.

* * * * *